US010738533B2

(12) United States Patent
Weyrauch et al.

(10) Patent No.: US 10,738,533 B2
(45) Date of Patent: Aug. 11, 2020

(54) PORTABLE LADDER PLATFORM

(71) Applicants: Shauna L. Weyrauch, Newark, OH (US); Walter A. Weyrauch, Newark, OH (US)

(72) Inventors: Shauna L. Weyrauch, Newark, OH (US); Walter A. Weyrauch, Newark, OH (US)

( * ) Notice: Subject to any disclaimer, the term of this patent is extended or adjusted under 35 U.S.C. 154(b) by 194 days.

(21) Appl. No.: 15/934,980

(22) Filed: Mar. 24, 2018

(65) Prior Publication Data

US 2019/0292850 A1 Sep. 26, 2019

(51) Int. Cl.
*E06C 7/16* (2006.01)
*E06C 7/50* (2006.01)

(52) U.S. Cl.
CPC . *E06C 7/16* (2013.01); *E06C 7/50* (2013.01)

(58) Field of Classification Search
CPC ..... E06C 7/16; E06C 7/165; E06C 7/50
See application file for complete search history.

(56) References Cited

U.S. PATENT DOCUMENTS 169,236 A 10/1875 Case et al.
407,079 A * 7/1889 Laskey ..... E06C 7/16 182/121
1,452,182 A 4/1923 Butrum
1,920,552 A 8/1933 Dollarhide
2,500,559 A * 3/1950 Miller ..... E06C 7/16 182/121
2,801,886 A * 8/1957 Peterson ..... E06C 7/16 182/121
2,871,067 A * 1/1959 Brogdon ..... E06C 7/16 182/121
3,112,811 A * 12/1963 Moran ..... E06C 7/08 182/120
3,294,197 A * 12/1966 Kwiatkowski ..... E06C 7/16 182/120
3,552,523 A * 1/1971 Berkley ..... E06C 7/16 182/121
3,899,045 A * 8/1975 Geisel ..... E06C 7/16 182/121
D248,777 S 3/1978 Spencer et al.
4,401,187 A 8/1983 Van Patten
4,437,544 A * 3/1984 Anderson ..... E06C 7/165 182/120

(Continued)

*Primary Examiner* — Katherine W Mitchell
*Assistant Examiner* — Shiref M Mekhaeil

(57) ABSTRACT

The Portable Ladder Platform is an innovative, convenient, sturdy portable ladder accessory for those who use a standard portable straight or extension ladder. The assembled invention provides a comparatively larger platform area for a more comfortable secure stance for anyone needing to work on a ladder for extended time. This invention abandons common platform arrangements that place the user standing outside the 'safe zone' (i.e., the area directly over the supporting rung, between the ladder side rails). A creative scheme includes the Locking Handle and the Horizontal Adjustment Screw which together secure the platform to the ladder during use. Emphasis toward user safety is reflected in elements reducing dangerous slipping and promoting platform stability. This ladder platform requires no tools to mount, moves easily and quickly from one level to another, and when mounted does not restrict ladder usage when stepping above or below the platform.

10 Claims, 9 Drawing Sheets

(56) References Cited

U.S. PATENT DOCUMENTS 4,482,030 A * 11/1984 Lincourt ..... E06C 7/16 182/121
4,586,586 A * 5/1986 Canals ..... E06C 1/12 182/118
4,646,878 A 3/1987 Moyer
4,687,075 A * 8/1987 Skaggs ..... E06C 7/16 182/121
4,909,351 A 3/1990 Johnson et al.
4,911,265 A * 3/1990 Skaggs ..... E06C 7/16 182/121
4,987,720 A * 1/1991 Wozney, Jr. ..... E04D 15/02 248/237
4,998,277 A * 3/1991 Rioux, Jr. ..... H04M 1/04 248/214
5,052,515 A 10/1991 Nowlan
5,060,755 A * 10/1991 Bourdages ..... E06C 7/16 182/121
5,072,808 A * 12/1991 Spalt ..... E06C 7/081 182/103
5,094,319 A * 3/1992 Kobasic ..... E06C 7/16 182/121
5,337,857 A 8/1994 Spalt et al.
5,429,205 A * 7/1995 Collins ..... E06C 7/14 182/122
5,465,809 A * 11/1995 Panicci ..... E06C 7/16 182/121
5,836,420 A * 11/1998 Marky, Jr. ..... E06C 7/16 182/121
5,881,433 A * 3/1999 Mutone ..... E05B 1/0053 16/422
6,109,392 A * 8/2000 Merrick ..... E06C 7/16 182/121
6,286,624 B1 * 9/2001 Bowles ..... E04G 1/30 182/117
8,366,061 B2 * 2/2013 Rose ..... B44D 3/14 15/257.06
8,684,139 B2 * 4/2014 Leng ..... A47C 12/00 182/129
9,068,395 B1 * 6/2015 Green ..... E06C 7/44
9,145,687 B1 * 9/2015 Bancroft ..... E06C 1/10
9,834,988 B1 12/2017 Arduna
2007/0074932 A1 * 4/2007 Mutscheller ..... E06C 7/00 182/107
2016/0369563 A1 * 12/2016 Adcock ..... E06C 7/46
2019/0335956 A1 * 11/2019 Gann ..... A47K 10/34

* cited by examiner

Fig. 6
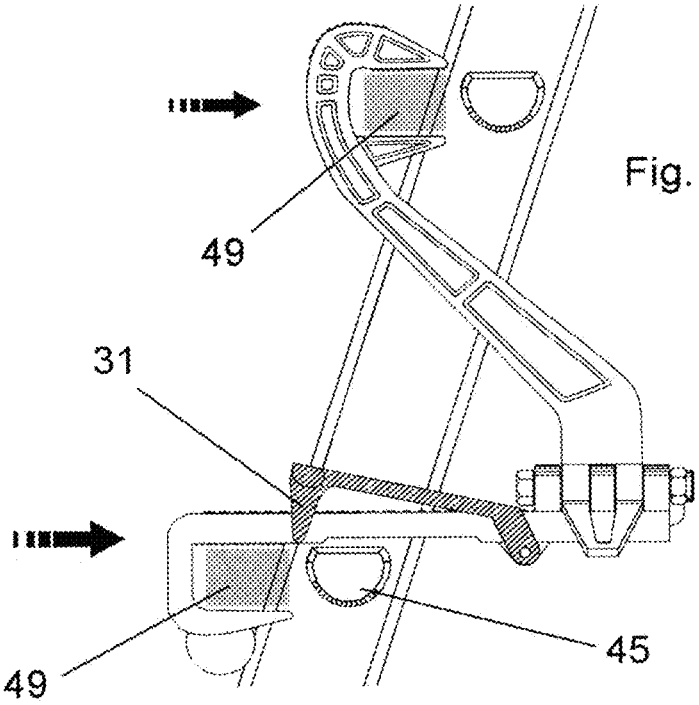
Fig. 6A
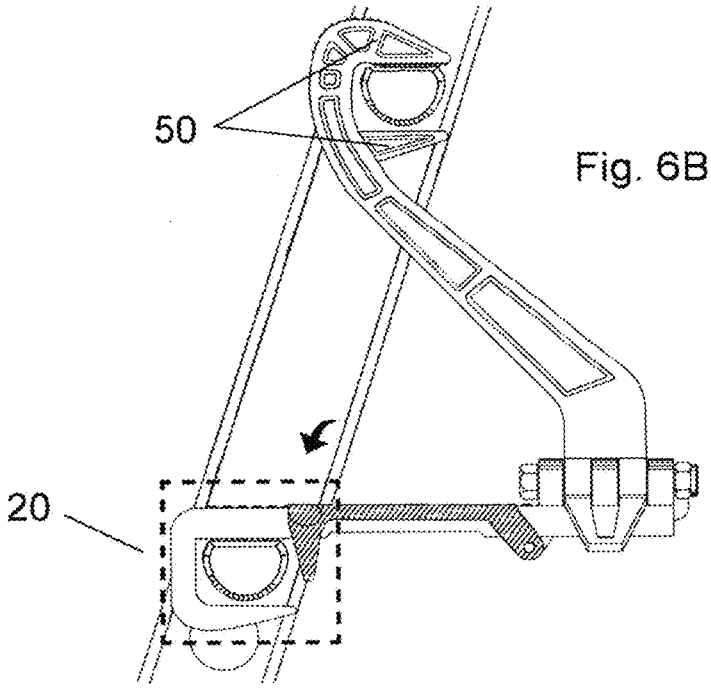
Fig. 6B

PORTABLE LADDER PLATFORM

CROSS-REFERENCE TO RELATED APPLICATIONS

Not Applicable

STATEMENT TO FEDERALLY SPONSORED RESEARCH OR DEVELOPMENT

Not Applicable

REFERENCE TO SEQUENCE LISTING

Not Applicable

BACKGROUND OF THE INVENTION

Field of the Invention

The invention relates generally to ladder platform attachments that provide enhanced comfort, function, and safety for a user when standing on a ladder.

Problems Involved in the Prior Art

The Portable Ladder Platform was conceived as a unique portable alternative solution to achieving a more comfortable and safe position while standing on a ladder. Further, it is noted here the Portable Ladder Platform is simultaneously recognized as a useful tray platform to provide a portable ladder mounted shelf for holding work items on a rung ladder.

Typically, various ladder platforms have been devised requiring the user to set up complex, heavy, and cumbersome mechanisms, some requiring tools and/or elaborate adjustments to secure to a ladder. Such inconvenient requirements create unnecessary safety risks during installation and can discourage platform use. Other devices have been offered with structurally simplistic designs that do not encompass potential functionality and/or durability characteristics leaving the invention inherently unsafe when used as intended.

Most portable ladder platform designs fail to account for other safety issues including metal construction creating a lightning attractor as well as a conduit for unintended electrical shorting. Ladder platform designs in use today often place user's stance on a platform base positioned outside what is known for purposes of this application as a ladder's 'safe zone' (i.e., the area directly over the user's supporting rung, between the ladder side rails). A stance outside the 'safe zone' shifts the user's weight to a position backward from the ladder which works against the tilt of the ladder, leaving the potential for tipping away from its proper placement (e.g., leaning against a wall).

Accounting for good platform stability when in place on the ladder is not always considered by platform designs in use today. Any unexpected platform movement when in its mounted position can cause loss of user balance and resulting accidents. Further, concern for good footing is overlooked by some platform designs, leaving a metal platform base with poor traction likely slippery particularly when wet.

A second problem inherent with ladder platform configurations which place users away from a ladder exists as the mounted device becomes an obstacle for the user. With the platform in place on the ladder, the ability of the user to climb up or down past the platform becomes dangerous or practically impossible without removing the platform first. Some devices solve the platform obstacle by requiring an awkward kicking down movement with one foot while standing on the upper adjacent rung. Asking such agility likely is uncomfortable for many users standing on a ladder, and appears to increase user peril of suffering an accident in the process.

A potentially dangerous problem related to many current ladder platform devices which place the platform base outside the 'safety zone' is the unrestricted ledge created that requires the user to maintain footing carefully over the base. When using these platforms any misstep moves the foot beyond the platform base, over the unrestricted ledge and increases the likelihood of falling from the ladder.

Other portable ladder platforms fail to account for user safety by overlooking platform to ladder unintended movement issues. Other designs do not address horizontal slipping when platform base is in mounted position. Also, many platform inventions hope to avoid loss of platform stability when mounted to a ladder by leaving simple platform to ladder contact friction to keep the platform device in place. Avoiding risks brought on by poorly constructed platforms for standing on a ladder should be a primary objective when designing such a device. However, safety related concerns are typically not addressed by many contemporary portable ladder platforms marketed today.

DESCRIPTION OF THE PRIOR ART

U.S. Pat. No. 169,236 to Case et al. Issued October 1875, one of the oldest relevant patents researched, discloses the Removable Ladder Step Device that is one of two (see Collins below) inventions found with basic features closest to the present Portable Ladder Platform invention. The Case et al. device arrangement overall is comparable as it also uses a two rung support arrangement whereas a lower rung supports the front of the base, and an upper adjacent rung supports the rear. Also, hooks are included for platform to upper rung connections; and the base extends inward (rather than outward) from the supporting lower rung. Not similar is the Case et al.'s invention's use of a 'confinement box' device to enclose the upper support rung (as opposed to entrapping the lower rung) to eliminate accidental displacement of the device when mounted to a ladder. The restriction of the Removable Ladder Step Device's 90° inverted base supporting bars limits base area. The present invention applies separate upper rung serpentine-shaped hook 'hanger' arms that attach to the base at rear-base corner hinge assemblies. The hanger arms are shaped to allow arm to base contact deeper than a 90° drop from upper rung, permitting a significant increase in useful base standing area.

U.S. Pat. No. 1,920,552 to Dollerhide reveals a similar basic design as Case et al. (above). Two rods with hooks rest over a ladder's upper rung to support the rear of an inward extending base. The opposite ends of the rods fix to the rear of a metal base; the front of the base itself shaped to hook over the lower supporting rung. The usable base area appears comparable to the present invention. Dollerhide's invention presents relatively simplistic construction reflecting little concern for safety enhancements or adaptability to various ladder types.

U.S. Pat. No. 407,079 to Laskey titled Ladder Platform Bracket issued Jul. 16, 1889 offers a single centered rear base supporting hooked bar arm to fix to the upper rung. While the base area is comparable to the present invention, such a design does not account for weight shifts to the poorly supported rear corners of the base and one can assume this device is inherently unstable.

U.S. Pat. No. 2,500,559 to Miller Ladder Platform places the base extending inward, as with several other patented inventions described herein. Miller's invention uses a two rung support (as does Case et al, Dollarhide, Laskey, and others) whereas the lower rung of the two is the front base area supporting rung and the adjacent upper rung is the rear base area supporting rung. The hanger arms are rods with hooks turned to approach the upper rung from back to front. This arrangement creates mounting obstacles on many contemporary ladders that restrict space behind the rungs. The hooks for fixing to upper and lower rungs are shaped strictly for round rung ladders, although adjustments could be made to permit other rung sizes and shapes. The present invention accounts for fitting to a variety of rung sizes and shapes commonly used today.

U.S. Pat. No. 2,801,886 to Peterson titled Combination Step and Scaffold Shelf for Ladders is a unique design attempting to permit reversing the device so that the base can be mounted inward (as a step) or outward (as a scaffold shelf) from the lower supporting rung. To mount the base inward a pair of chains are fastened to the left and right rear (inward) corners of the base. The chains are equipped with hooks designed to fix the chains to the second rung above the lower rung. The present invention confines mounting to two adjacent rungs to limit involving obstacles behind the rungs and to keep device dimensions minimized. Because chains, straps, ropes and wires being limp and difficult to control can cause mounting difficulties while standing on a ladder, the present invention does not involve them in its design. The front of the base of Peterson's device simply rests on the lower rung. Reversing the invention to extend outward provides a dubious scaffold shelf that appears to be unusable.

U.S. Pat. No. 9,834,988 to Arduna titled Ladder Platform Attachment discloses a platform base that uses two adjacent rungs with the base resting unfixed on the lower rung. A single serpentine shaped hanger arm rod vertically beneath the upper support rung and centered between the ladder rails is fixed via a rearward facing hook to the upper rung. The rod protrudes into a cavity in the floor of the base and 'T's to turn 90° left and right outward to provide base support for the rear of the base. Claimed to be designed "for increasing a person's safety when standing on a ladder", the lack of secure, stable mounting across the rear of the base floor—imperative to supporting a user's weight—appears to invite side to side movement of the device leaving it unsafe when employed as intended.

U.S. Pat. No. 3,899,045 to Geisel, et al. titled Ladder Platform reveals "A safety platform for conventional ladders." This invention shares several features with the present invention, including a two adjacent rung mounting design, rear base supporting rear facing hooked upper rung hanger arms, and a base front rung hook that supports the front of base. An interesting "safety latch, gravity biased to a latched position" located behind the upper support rung "prevents relative movement between the platform and the ladder" seems innovative. Geisel's safety latch, however, when mounted to a typical extension ladder, would fail to properly mount due to interference behind the outer upper support rung. Similar in intent, the present Portable Ladder Platform invention promotes a unique Locking Handle feature which, when closed, traps the lower support rung in a 'confinement box' and prevents unintended dismounting of the device without interference.

U.S. Pat. No. 4,482,030 to Lincourt titled Support Platform discloses another device similar in basic design to the present Portable Ladder Platform invention. Those include a rearward extending base, a two adjacent rung mounting design, rear base supporting rear facing hooked upper rung hanger arms, and a base front rung hook that supports the front of base. For this invention the upper and lower rung hooks are shaped from outer flat iron bans that support the left and right sides of base (see Case et al. above). The invention appears to properly support the base; however, no attention to accidental displacement of the mounted device has been applied leaving the device a poor safety design.

U.S. Pat. No. 4,911,265 to Skaggs titled "Ladder platform with rung securing mechanism" discloses basic design similar to the present invention and others (see Case et al. above). The area of inventive interest with Skaggs' offering concerns two unique rung fixing mechanisms to stabilize the mounted platform. A gravity biased bar pivots above and behind the upper support rung, and, when allowed to drop down, appears to encase the rung successfully in a confined space. A lower support rung "locking element" is somewhat less clear in its purpose. The action for locking the lower support rung involves wedging the rung between a stop and a spring biased mechanism, suggesting horizontal stabilizing of the base."

U.S. Pat. No. 4,909,351 to Johnson, et al. titled Platform attachment for a ladder discloses a device which uses the basic design similar to the present invention and others (see Case et al. above). This invention incorporates a distinctive fixing technique using the upper supporting rung to secure the platform to a ladder. Long screws with wing nuts are arranged behind and beneath the upper rung by tightening them in positions available through holes in the two upper arm hanger bar hooks. This feature is of comparative interest in respect to the placement of an entrapping mechanism (two elongated screws) beneath the upper support rung. A resistance below the upper rung—the lower hanger arm jaws as used by the present invention—prevents base tipping and teetering over the lower support rung when user weight is applied. This is an important detail in design particularly when the platform base floor extends outward beyond the front edge of the lower rung.

U.S. Pat. No. D248777 to Spencer et al. titled Ladder Platform issued Aug. 1, 1978 offers one of the early devices of a contemporary commercially successful basic design. Such ladder platforms typically apply an outward extended base supported by two adjacent rungs where the upper rung supports the rear of the base and the lower rung supports the front of the base. The upper rung rests directly on the base, using an edge stop bar that extends downward from the rear edge of the base to prevent the base from disengaging the support rung. The lower rung supports the front of the base using two rods (or bars) fixed to the front corners of the base. Typically, U-shaped hooks attached to the lower ends of the support rods rest on the lower rung. Base arrangement outside the ladder's 'safe zone' (i.e. standing between ladder rails directly over the supporting rung) leaves the user of this basic configuration on a virtual cliff where a simple misstep can lead to falling and serious injury. Shifting user weight away from the ladder promotes ladder instability. Spencer et al.'s device, and similar devices, once mounted to a ladder, creates a block to user movement on a ladder, requiring an unnatural and potentially dangerous kicking of the device while standing on the rung above. Identifying the general weaknesses of Spencer et al, and very similar ladder platform designs in use today provided inspiration for creating the present invention without them.

U.S. Pat. No. 4,646,878A to Moyer titled Portable ladder step filed Jun. 27, 1986. Moyer's invention uses a lower rung base support and upper rung hanger support, similar to the present invention; however, the base extends outward from a ladder posing the various problems discussed herein.

U.S. Pat. No. U.S. Pat. No. 5,052,515A to Nowlan titled Ladder step support filed Aug. 3, 1990. This simplified device uses a lower base rung and upper center post hanger rung. As with numerous cited examples, this design places the user outward, away from the security of a ladder supporting rung. Few features concerning user safety are apparent.

U.S. Pat. No. 5,429,205A to Collins; David titled Ladder platform accessory filed Jun. 20, 1994. Collins' device shares several similarities with the present invention. Using the lower base rung/upper hanger rung support design with the base placed inward from the lower rung is relatively rare among searched patent grants. Beyond those details, an apparatus Collins included to secure the upper rung in a containment box is comparable to the present invention. The Portable Ladder Platform of this application uses a unique mechanism to trap the lower rung, instead, allowing a simple mounting procedure onto multiple ladder rung types. Collins' Ladder platform accessory requires setup adjustments and as offered, can be used exclusively on straight round rung ladders.

U.S. Pat. No. 4,401,187A to Van Patten titled Ladder platform accessory issued Aug. 30, 1983 is a device using a ladder lower rung for supporting the front of an inward mounted base and an adjacent upper rung for supporting the rear. The hanger rods used to support the rear employ hooks that are turned toward center to insert into the upper rung from outside the two ladder rails. This arrangement requires a ladder to have rungs with hallow ends open for such insertions, and thereby restrict the application. Further, this approach to finding hanger support appears to exclude mounting to extension ladders.

U.S. Pat. No. 1,452,182A to Butrum titled Platform ladder jack issued Apr. 17, 1923 offers a reversible platform device employing a ladder rung for support of one end of the base and one of two rungs to support the other end. The invention extends two support rods either upward two rungs—if the base is to be turned inward from a ladder—or downward two rungs—if the base is to be mounted outward from a ladder. This is a curious design, but appears to be viable. As with some other devices, Butrum's offering evidently requires careful set up adjustment, does not account for fitting to various ladder rung types, and lacks focus on safety concerns.

U.S. Pat. No. 5,337,857A to Spalt et al. titled Ladder adaptable platform issued Aug. 16, 1994. One postulation inferred by this application concerns the advantages of placement of the platform base of any ladder platform design over and inward from the base supporting rung. To that end, Spalt et al.'s invention succeeds by using a single supporting rung together with brackets to add support from the ladder rails. The device requires a fit between the brackets and rails, limiting the mounting to ladders with matching rails. The brackets also eliminate attaching Spalt et al.'s invention to extension ladders.

SUMMARY OF THE INVENTION

The Portable Ladder Platform is a device designed to provide expanded standing space when mounted onto a common 'D' shaped rung equipped straight or extension ladder. It should be understood the present invention also mounts to other rung shapes; however, for the purpose of this description 'D' shaped rungs will be referenced. Further, the present invention's claimed innovations should be recognized as applicable to modified designs allowing fitting to other ladder types (i.e. step, folding, telescoping).

Standing for extended length of time in one position on a typical ladder is uncomfortable, asking the user to support their weight on relatively thin ladder rungs. Ladder platforms of various designs have addressed this problem, but have created other problems for the user. (See "Background of the Invention section.)

The Portable Ladder Platform presents an alternative platform that is portable and simple to mount onto ladder rungs requiring no tools.

Made of light weight yet strong molded nonconductive plastic rather than the near universal use of metals by other invention devices, the present invention will not draw lighting or conduct accidental electrical shorting.

Being relatively small and light weight permits the Portable Ladder Platform to be moved quickly and easily from one position on the ladder to another.

The standing area (base) of the platform is kept within the 'safe zone', over a supporting ladder rung and between the ladder rails. This arrangement maintains user weight distribution that ladder manufacturers expect.

The two upper rung hanger arms are designed to allow mounting to either single rail or extension ladders (where two abutting rails can be involved) with no modifications or adjustments.

An important innovative secure Locking Handle confines the lower rung (the rung supporting the front of the platform base) in a containment area during use. When mounting, the Locking Handle is lifted, moving two handle prongs up and out of the way. Once the user positions the Portable Ladder Platform on a ladder, the handle is lowered moving the prongs behind the supporting rung, preventing the platform from moving out of working position. Simply lifting the Locking Handle allows the present invention to be dismounted and repositioned to another rung, or removed from use.

The unique Horizontal Set Screw, once properly adjusted during mounting, removes any left to right looseness between the platform and the ladder rails, helping to stabilize the platform when in working position.

Designed to be safe and easy to use, the Portable Ladder Platform eliminates the awkward and potentially dangerous problem of climbing up or down past a mounted, outward protruding platform. The present invention keeps the platform base over and behind the supporting rung allowing the user to step from the upper or lower rung directly onto the platform, as well as stepping from the platform up or down to an adjacent rung with no obstruction.

STATEMENT OF THE OBJECT OF THE INVENTION

The object of this invention is to bring to the market a ladder platform that is simple and easy to use as well as being thoughtfully designed to consider and minimize safety issues inherent in the use of any platform mounted to a ladder.

BRIEF DESCRIPTION OF THE SEVERAL VIEWS OF THE DRAWING

Where there are drawings, you must include a listing of all figures by number (e.g., FIG. 1A) and with corresponding statements explaining what each figure depicts.

FIG. 6A is the first of two right side sequenced illustrations of the assembled invention. The sequence highlights the invention—a ladder platform—being placed and secured to a cutaway section of a typical ladder. FIG. 6A depicts a cutaway view of a segment of a typical ladder with the invention (platform) to its left. The platform has not been mounted to the ladder.

FIG. 6B is the second of two sequenced illustrations of the assembled invention showing the right side of the platform and a cutaway view of a segment of a typical ladder. This drawing shows the invention (platform) moved to mount with the ladder. It also shows the locking handle moved (lowered) to lock the lower rung in containment (locked) position.

FIG. 7D returns to full view of the assembled invention from the front right to left 45 degree upper side. This drawing shows the fully collapsed right upper rung hanger arm, and suggests the same procedure is necessary to collapse the left upper rung hanger arm.

FIG. 9A illustrates a generic ladder platform design in use today mounted on a cutaway view of a typical ladder. An image of a user standing on the platform illustrates the user's position in relation to the ladder and as compared to the user's position on the invention (subject of this application) in FIG. 9B.

DETAILED DESCRIPTION OF THE INVENTION

Figure 1:
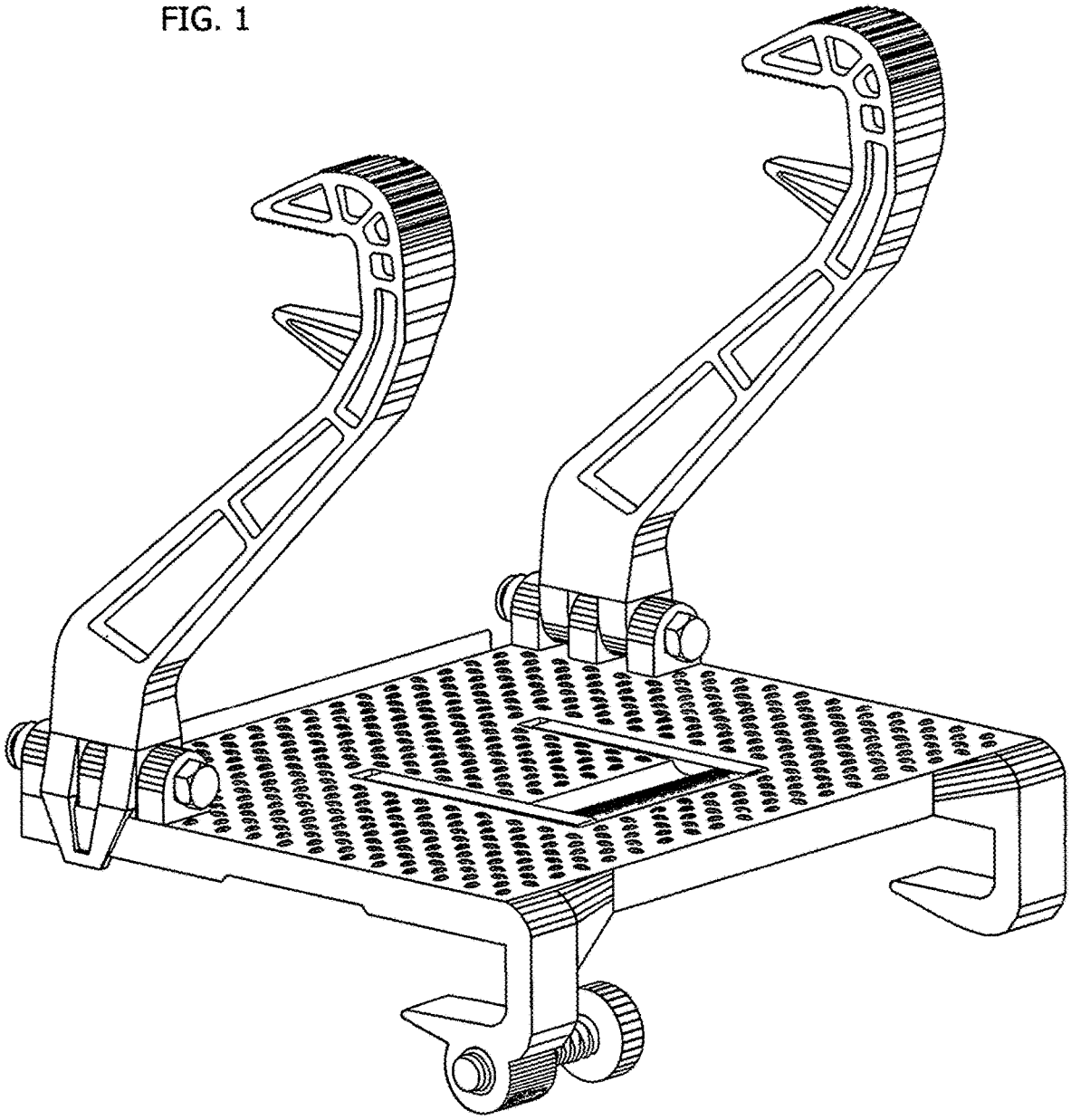
FIG. 1 is a front left to right 45 degree view of the upper side of the assembled invention. It shows details of the front, top, and left side of the invention as seen from this perspective.

Climbing a typical contemporary portable straight or extension ladder to a height where the user will need to stand in place for an extended time on a relatively narrow ladder rung leads to user feet and leg fatigue and discomfort. To help address this problem ideas leading to portable (detachable) ladder platforms have produced a number of variations.

A critical basic difference between the present invention's platform mounting strategy and previous ladder platform designs involves the common use of 'hooks' for hanging a platform over supporting ladder rungs. This invention abandons hooks in favor of the technique of inserting two adjacent supporting ladder rungs into lower left and right rung A slots 7 (FIG. 4) and concurrently the passive employment of upper left and right rung B slots 50 (FIG. 6B) within which the rungs are contained on three sides. The open sides to the rear of the slots allow direct platform mounting and dismounting by simply sliding the platform assembly inward or outward over the supporting rungs. A locking handle 2 (FIG. 5), when open, allows base rung A's 45 (FIG. 4) insertion, and when closed, forms a four sided rung containment 'box' 20 (FIG. 6B) to keep the platform in place on the ladder. This method permits successful platform mounting on most straight and extension ladders by avoiding conflicts with interfering rungs of secondary sections directly behind the supporting rungs. This is a common limiting problem when other ladder platforms employ hooks. Mounting the portable ladder platform to a straight or extension ladder requires two steps: step 1 the user grasps with one hand the locking handle grip rod 30 (FIG. 5) lifting and guiding the invention into position so that the base 1 rests in contact over a chosen ladder base rung A. This step includes the subsequent passive mounting of two platform upper rung hanger arms 3/4 to rest over a second adjacent upper rung B above base rung A. Once the present invention is in position contacting the two rungs, the handle is released to drop into a locking position explained further below. Step 2 (also further explained below) has the user turn the horizontal adjustment dowel 6 (FIG. 5) clockwise effectively moving the platform horizontally along the rungs until any excess gap between the platform and the ladder rails is closed. This mounting process is reversed to remove the platform from the ladder. When mounted the portable ladder platform does not interfere with normal movements of stepping up or down a ladder.

No one platform design has been universally mounted to all existing ladder types. Varieties of ladders are many, with widely varying dimensions critical to properly fitting a ladder platform to them. That is why the present invention is intentionally limited in design to be mounted to a standard portable 'D' shaped rung straight or extension ladder that is popular today. Be it known the Portable Ladder Platform can be re-configured without adjustment to claims made herein to custom fit other types of ladders. Also, this initial platform design is proposed to be made of injection molded plastic parts; however, extruded aluminum can be an acceptable substitute. If the assembled invention's claims are reduced to simplify the design, steel could be used to fabricate its parts. The general design advantages described in this application should be transferable to nearly all portable ladder varieties that could benefit from a platform attachment.

Figure 5:
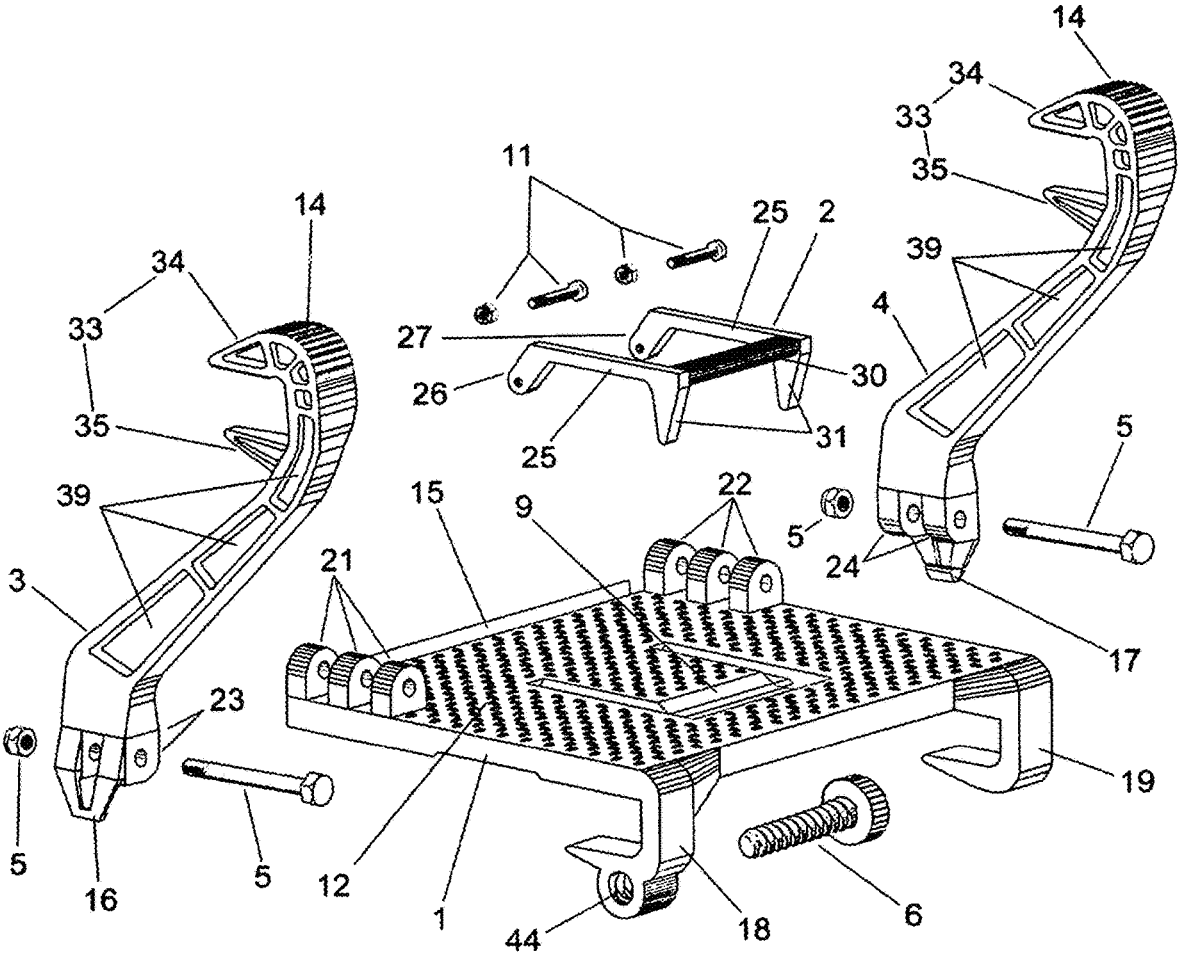
FIG. 5 is an exploded view of FIG. 1. It provides an unrestricted look at the numbered individual parts of the invention from the front upper side of a left to right 45 degree perspective.

As shown in FIG. 5, the Portable Ladder Platform is made of five separate molded plastic parts, along with four metal bolts and matching locknuts. The molded plastic parts include the Base 1 of the platform, Left Upper Rung Hanger Arm 3, Right Upper Rung Hanger Arm 4, a Locking Handle 2; and a coarse threaded Horizontal Adjustment Dowel 6.

Figure 3:
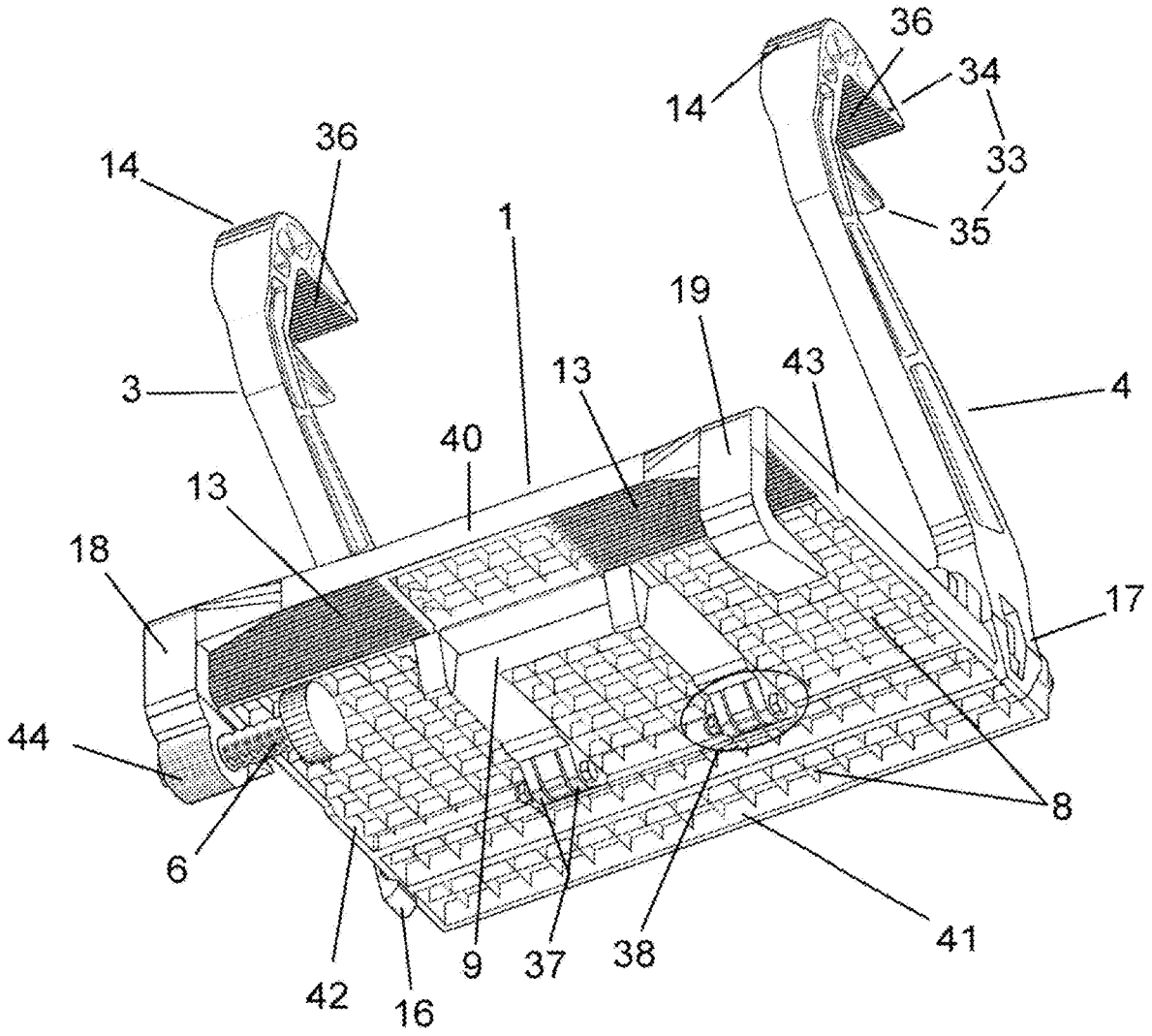
FIG. 3 is a front left to right 45 degree view of the lower side of the assembled invention. It shows numbered details of the underside of the invention as seen from this perspective.

Referring to FIG. 3, the base 1 is comprised of plastic and is a rectangle a of a size to maximize within practical limits the use of available area existing broadly above a ladder rung and between the ladder rails. Base 1 thickness, as well as thickness of all molded plastic parts is determined by consideration of required strength/stress tolerances verses ideal economy of production. Four walls equally extend vertically downward from the base perimeter; including front base downward reaching vertical wall 40, rear base downward reaching vertical wall 41, left base downward reaching vertical wall 42, and right base downward reaching vertical wall 43.

Figure 4:
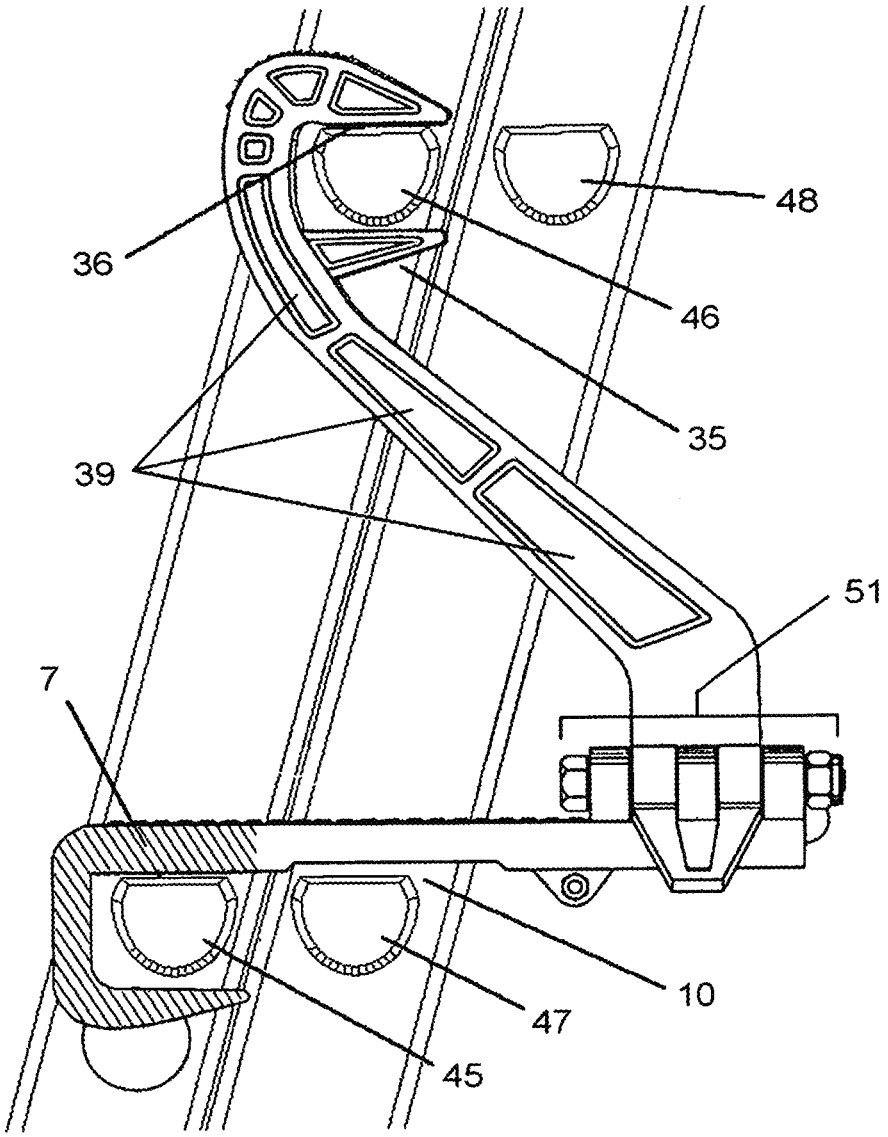
FIG. 4 shows the right side of the assembled invention and a cutaway view of a segment of a typical extension ladder. In this drawing the contact points where the invention mounts on the ladder are pointed out. It shows the cutaway views of a ladder's base rung A and upper rung B supporting the invention's base front and rear. Base to lower ladder rung traction pads for contacting base rung A and upper rung B are indicated. This drawing also identifies of the invention's two hanger arm-to-base hinge assemblies.

FIG. 3 identifies the left and right base lower rung slot elbows 18/19 which extrude downward and rearward 90 degrees from the left and right corners of the front base downward reaching vertical wall 40. FIG. 6A is a right side cutaway view of the present invention. The left and right upper and lower rung containment areas 49 (FIG. 6A) are illustrated by shaded blocks. The lower rung containment areas 49 are created by the left and right base lower rung slot elbows 18/19 (FIG. 3) together with a forward segment of the respective left and right base downward reaching vertical walls 42/43 (FIG. 3) forming three sides of left and right rung A slots 7 (FIG. 4). FIG. 6A & FIG. 6B suggest the action of moving the present invention into mounting position on a typical ladder. The base rung A 45 (FIG. 6A) is inserted into the lower rung containment area 49 (FIG. 6A) followed by lowering the locking handle 2 (FIG. 2B) into the base locking handle cradle 9 (FIG. 5). A locking handle grip rod 30 (FIG. 5) is created by extruding the locking handle grip rod inward across the distance from the front ends of two locking handle side rails 25 (FIG. 5). When lowered these two locking handle side rails 25 seat against the base locking handle cradle 6 (FIG. 5) supporting the locking handle 2 (FIG. 5) in a horizontal position. Once the locking handle 2 (FIG. 5) is horizontal, the locking handle gate prongs 31 (FIG. 6A) are extending downward directly behind the inserted base rung 45 (FIG. 6A), obstructing its removal from the left and right rung A slots 7 (FIG. 4). The lowered gate prongs complete a four-sided rung containment 'box' 20 (FIG. 6B) that traps the rung from accidently moving out of mounted position. This innovative box mechanism helps to secure the portable ladder platform against accidental platform dislodging while in use.

Figure 2A:
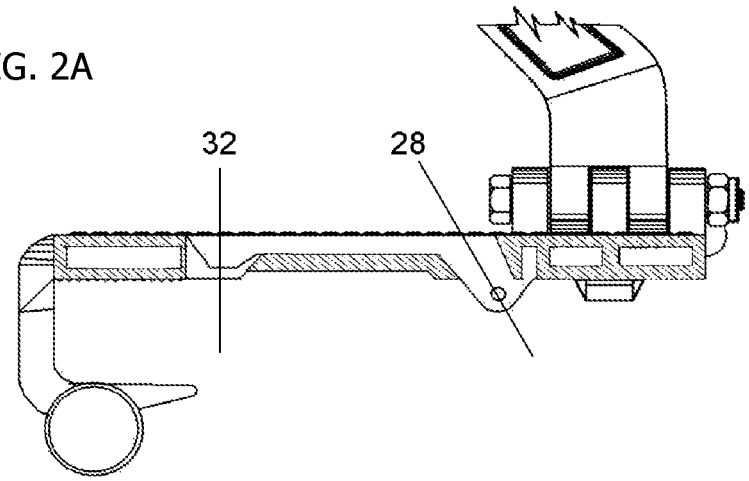
FIG. 2A is a detail cutaway view of the right side of the assembled invention excluding the locking handle. It focuses on the base locking handle cradle and how it permits the locking handle to function.
Figure 2B:
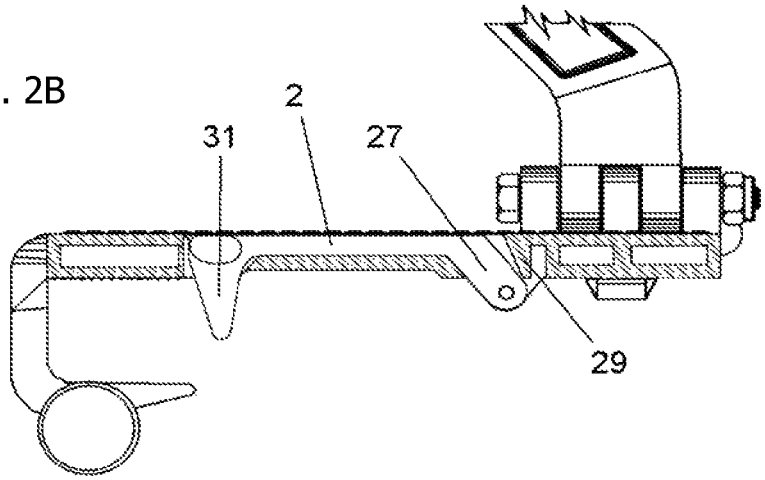
FIG. 2B is a detail cutaway view of the right side of the assembled invention. It shows the locking handle seated in the locking handle cradle and the location of a base locking handle cradle limitation pad.
Figure 2C:
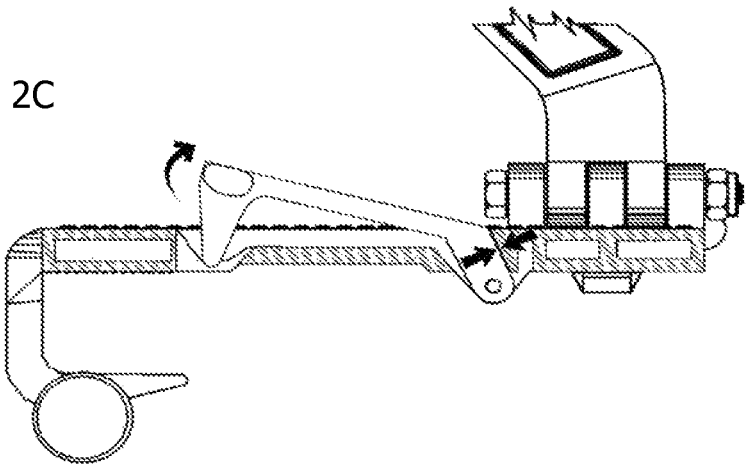
FIG. 2C highlights the function of a base locking handle cradle limitation pad when the locking handle is lifted.

FIG. 2A, FIG. 2B, and FIG. 2C are detailed cutaway views of the right side of the portable ladder platform. FIG. 2A focuses on the base locking handle cradle 9 (FIG. 5) located in the general center of the base 1 (FIG. 3) [H] where the locking handle 2 (FIG. 2B) is removed for clarity. FIG. 2A locates one of two base locking handle cradle hinge knuckle passages 28 which left and right locking handle male hinge knuckles 26/27 (FIG. 5) to pass through the thickness of the base 1 (FIG. 3). Similarly two cradle gate prong passages 32 (FIG. 2A) allow locking handle gate prongs 31 (FIG. 5) to pass through these openings in the base 1 (FIG. 3). FIG. 2B shows the locking handle 2 seated in place in the base locking handle cradle 9 (FIG. 5). Two base locking handle cradle limitation 29 (FIG. 2B) are features of the base locking handle cradle designed to restrict range of movement by the locking handle 2. FIG. 2C illustrates the restrained movement of the locking handle 2 (FIG. 2B) forced by two cradle limitation pads 29. Lifting the locking handle a measured amount raises the locking handle gate prongs 31 (FIG. 5) enough to permit passing the base rung A 45 (FIG. 4) for mounting/dismounting the present invention to/from a typical straight or extension ladder.

Figure 8A:
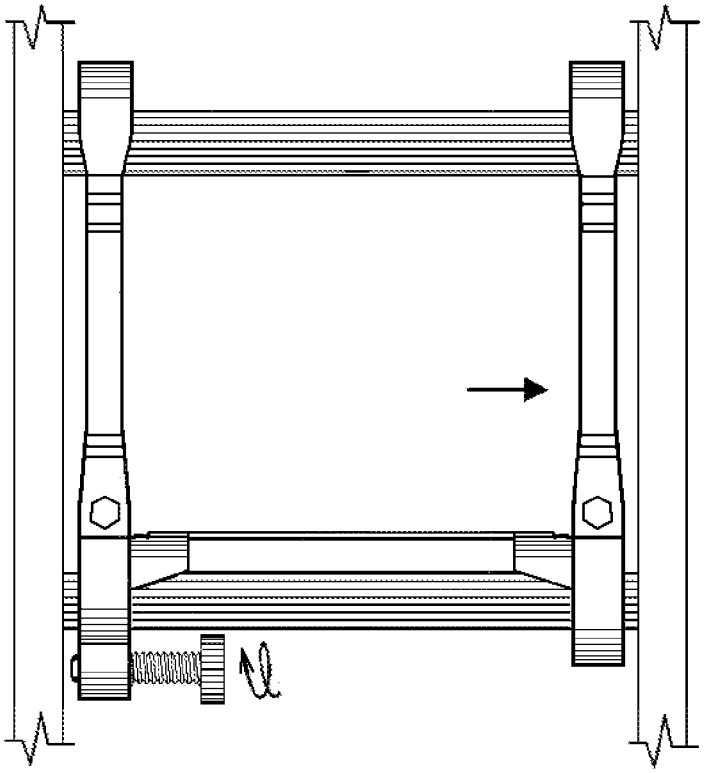
FIG. 8A is the first of two front view sequenced illustrations of the assembled invention. This illustration shows a segment of a typical ladder with the invention (platform) in mounted position. Two motion arrows depict the screwing action of the horizontal adjusting screw, and the resulting leftward movement of the platform relative to the ladder.
Figure 8B:
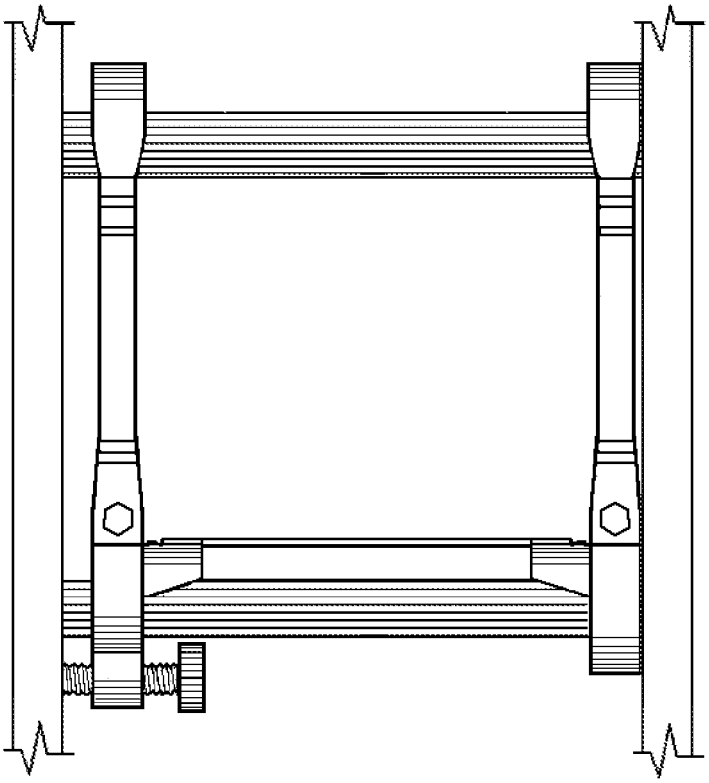
FIG. 8B is the second of two front view sequenced illustrations of the assembled invention. This illustration shows the resulting horizontal movement of the platform assembly into a secure pinned position between the rails of the ladder.

Again referring to FIG. 3, any unexpected movement of a mounted ladder platform, regardless how slight, can at least be distracting for the user, and potentially lead to accidents. Extruding downward from the left base lower rung slot elbow 18 (FIG. 3) is the threaded dowel socket 44 (FIG. 5). The threaded dowel socket is the mated coarse threaded fitting for the horizontal adjustment dowel 6 (FIG. 5) to screw through. At the trailing (right) end of the horizontal adjustment dowel 6 is an enlarged circular knurled dowel head which allows the user to hand-adjust the dowel's depth through the threaded dowel socket 44 during mounting. As suggested in FIG. 8A, the dowel, when turned clockwise, moves right to left through the socket until the left tip of the dowel contacts the inner wall of the ladder's left rail. Turning the dowel further forces the movement of the entire platform rightward until the right side of the base 1 is contacting the right ladder rail frame. This procedure, concluded in FIG. 8B, effectively removes excess horizontal space and pins the portable ladder platform within the ladder rails, preventing horizontal movements. During platform dismounting the horizontal adjustment dowel 6 (FIG. 5) is moved away from the pinned position by turning the knurled dowel head counter clockwise until the dowel is backed away enough for removing the platform.

The left and right upper rung hanger arms 3/4 (FIG. 5) are each attached to the base 1 using left and right hanger arm-to-base hinge assemblies 51 (FIG. 4). One hinge assembly is shown in FIG. 4's cutaway side view illustrating the assembled hinge pivoted into vertical (mounting) position. The left and right hanger arm-to-base hinge assemblies 51 (FIG. 4) are formed by left and right base female hinge knuckles 21/22 (FIG. 5) rising upward vertically from the left and right rear corners of the base. Left and right base female hinge knuckles 21/22, (FIG. 5) fit to left and right upper rung hanger arm male hinge knuckles 23/24 (FIG. 5) extending downward from the lower ends of the left and right upper rung hanger arms 3/4 (FIG. 5). Two hanger arm hinge bolts and two hanger arm hinge locknuts 5 (FIG. 5) serve as hinge pins to complete the left and right hanger arm-to-base hinge assemblies 51 (FIG. 4).

The present invention includes the left and right hanger arm-to-base hinge assemblies 51 (FIG. 4) as a mechanism permitting each upper rung hanger arm to collapse inward in a folding motion, effectively reducing overall portable ladder platform height. Reducing overall height aids in transporting and storing the present invention. To lock the upper rung hanger arms into vertical position with respect to the base, left and right hanger arm snap latches 16/17 (FIG. 5) are employed. FIG. 7A through FIG. 7E present a stepped sequence of drawings discussed herein.

Figure 7A:
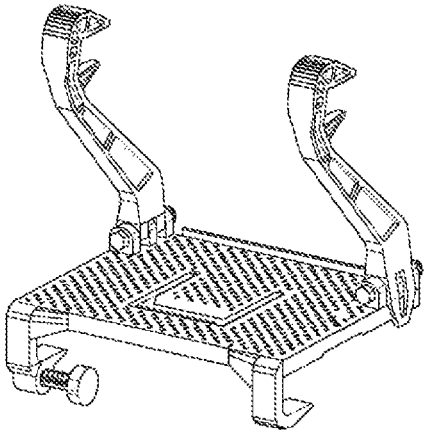
FIG. 7A is the first in a sequence of five illustrations showing a front right to left 45 degree view of the upper side of the assembled invention. This drawing shows the right and left upper rung hanger arms erected into mounting position.

FIG. 7A is a front right to left 45 degree view of the assembled present invention showing left and right hanger arm-to-base hinges 51 (FIG. 4) in the vertical position. Semi-flexible left and right hanger arm snap latches 16/17 (FIG. 5) are extruded downward from the lower outboard sides of the left and right hanger arm male hinge knuckles 23/24 (FIG. 5). The left and right hanger arm snap latches 16/17 (FIG. 5), when engaged with lower edges of the left and right base walls downward reaching vertical walls 42/43 (FIG. 3), maintain left and right upper rung hanger arms 3/4 (FIG. 5) in vertical positions, preventing their inward collapse. Further, left and right upper rung hanger arms 3/4 (FIG. 5) are blocked from pivoting outward from vertical by 90 degree stop corners designed into the outward sides of left and right hanger arm male hinge knuckles 23/24 (best illustrated by FIG. 5 and FIG. 7C).

Figure 7B:
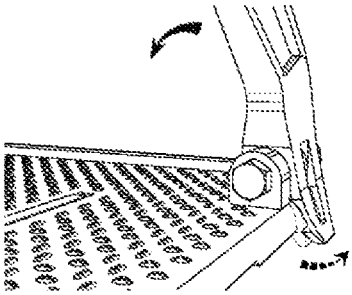
FIG. 7B is the second of five sequenced illustrations. This drawing is an enlarged detail of the right rear corner of the assembled invention. It focuses on the right hanger arm-to-base hinge assembly and its snap lock's movement necessary to collapse the arm into transport/storage position.

FIG. 7B is a detail of the action of releasing from vertical the right upper rung hanger arm 4 (FIG. 5). When adequate pressure against the right hanger arm snap latch 17 (FIG. 5) bends it back enough to release the latch from engagement with the right base downward reaching vertical wall 42 (FIG. 1) the right upper rung hanger arm snap latch 17 (FIG. 5) is disengaged and the right upper rung hanger arm 4 (FIG. 5) is allowed to collapse inward. Once released and pressure is relieved, the snap latch returns to its unpressured position. The same procedure is used for both right and left snap latches.

Figure 7C:
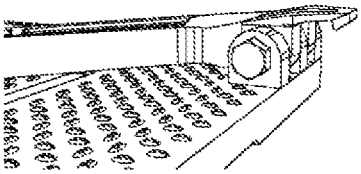
FIG. 7C is the third of five sequenced illustrations. This drawing is an enlarged detail of the right rear corner of the assembled invention. It focuses on the right upper rung hanger arm hinge and its snap lock released and the right upper rung hanger arm collapsed into transport/storage position.

FIG. 7C depicts a detail of the fully collapsed right upper rung hanger arm 4 (FIG. 5).

Figure 7D:
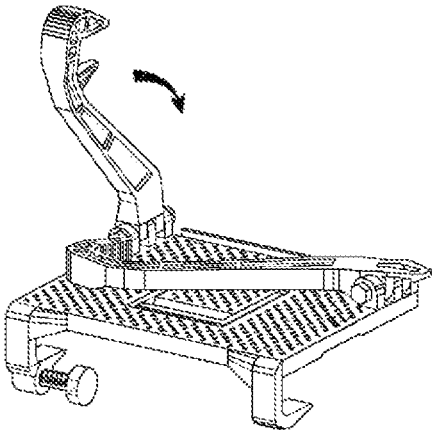
FIG. 7D is the fourth of five sequenced illustrations.

FIG. 7D suggests the identical procedure is necessary to collapse the left upper rung hanger arm 3 (FIG. 5).

Figure 7E:
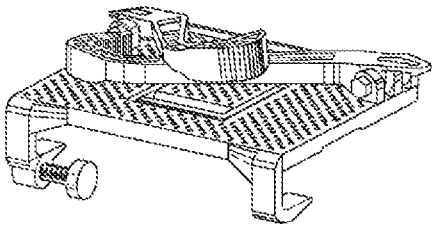
FIG. 7E is the fifth of five sequenced illustrations. The figure shows the fully collapsed left and right upper rung hanger arms.

FIG. 7E shows the altered platform profile created when both upper rung hanger arms are fully collapsed for transport or storage.

Referring again to FIG. 5, the Locking Handle 2 (explained above as including two locking handle gate prongs 31) is attached to the base 1 using two locking handle bolts and two locking handle locknuts 11 (FIG. 5) to serve as pins in left and right locking handle to base hinge assemblies 38 (FIG. 3). The left and right locking handle to base hinge assemblies 38 (FIG. 3) further consist of left and right locking handle cradle female hinge knuckles 37 that are features of the base locking handle cradle 9 (FIG. 3). The locking handle cradle female hinge knuckles 37 (FIG. 3) are extruded downward below the cradle where they fit to left and right locking handle male hinge knuckles 26/27 (FIG. 5) to complete the two locking handle hinge assemblies 38 (FIG. 3). When the user engages the locking handle 2 (shown best in FIG. 2C) it pivots at the two locking handle hinge assemblies 38 (FIG. 3) to permit the handle to move upward or downward through a limited range. This movement allows mounting and dismounting the present invention to and from a ladder as the locking handle gate prongs 31 (FIG. 5) open and close the four sided rung containment 'box' 20 (FIG. 6B).

Relating to FIG. 3, the platform Base 1 is designed to be light weight yet strong employing injection mold cross ribbing and gussets where applicable. The illustration shows a Base Rib Array 8 that allows the removal of much of the base plastic mass without losing base integrity. Ribs are shaped and distributed as recommended by mold designers with details such as rounded corners to allow easier removal from the mold, and wall to rib widths to produce optimum strength and cosmetic finish to meet the Portable Ladder Platform's requirements.

FIG. 3 shows two corrugated base to lower ladder rung traction pads 13. FIG. 4 provides a right side view of a traction pad mounted over a base rung A 45. Most D shaped ladder rungs have textured surfaces of various designs to limit slipping. Unnecessary slipping and movement between a ladder platform and the ladder rung can cause accidents. The present invention's traction pads help to insure good grip when contacting the rung.

Occupational Safety and Health Administration (OSHA) regulations set standards for various portable ladder measurements. Competing ladder manufacturers follow these standards which produces very similar dimensions in important areas leading to general uniformity in ladder production. This uniformity provides the information necessary to set optimal portable ladder platform dimensions. As shown in FIG. 3 the underside of the platform device presented in this application has a floor size that takes advantage of maximum area within the ladder rails. Compared to a ladder rung, the relatively ample space takes advantage of nearly all area practically available.

Rising as an extruded feature from the base surface (FIG. 5) is the base traction grid 12, a unique tread designed for enhanced traction.

When setting up a ladder, failing to set the ladder angle within manufacturers' recommended 70°-75° range can lead to accidents. Placing a ladder at a steeper angle temps ladder collapse, and produces a slanted platform angle that could make footing prone to slipping. Drawn in FIG. 5, along the back edge of the floor is a base rear edge slip guard 15 an outward/upward extruded feature of the rear base downward reaching vertical wall 41 (FIG. 3) that forms a vertical ledge from the rear of the base 1 (FIG. 5). The base rear edge slip guard 15 (FIG. 5) provides slip resistance and warns the user when the user's feet are at the back edge of the available standing space. The base rear edge slip guard 15 (FIG. 5) also serves as a restraint to keep tools, paint supplies, etc. from sliding off the rear of the platform should it be used as a ladder caddy (shelf).

Refer to FIG. 4 illustrates the right side of the present invention. When two rungs of two adjacent ladder rails are together as a consequence of two segments of an extension ladder in alignment at the user's desired position (see examples: upper rung B/secondary rung B2 46/48, and base rung A/secondary rung A2 45/47 FIG. 4), slight ladder manufacture variances can create interference with proper platform to rung seating. Should the secondary rung A2 47 directly behind the base rung A 45 rise above base rung A and contact the platform, a rocking or teetering effect will result. To prevent this potential unwanted contact when mounted to an extension ladder, a recessed area 10 (FIG. 4) transverses the underside of base 1 providing extra clearance in this area. The recessed area relieves unintended platform to secondary rung contact, and unwanted platform instability is avoided.

The present invention includes serpentine shaped left and right upper rung hanger arms 3,4 (FIG. 5) with left and right hanger arm snap latches 16/17 (FIG. 5) extruded downward from left and right hanger arm male hinge knuckles 23/24 (FIG. 5). The upper rung hanger arms 3/4 (FIG. 5) are designed to support weight load shifts toward the rear of the base 1 (FIG. 5). To that end, the hanger arms employ known strength/stress enhancing techniques common to plastic injection molding. Similar to base rib arrays 8 (FIG. 3) designed to reduce material use and weight while maintaining strength, both left and right upper rung hanger arms use upper rung hanger arm cavity arrays 39 (FIG. 4 & FIG. 5) for like purposes.

FIG. 5 illustrates both left and right hanger arm jaw assemblies 33 (FIG. 5), that are rearward extruded features of upper areas of the upper rung hanger arms 3/4 (FIG. 5). The left and right hanger arm jaw assemblies 33 (FIG. 5) are necessary to serve as left and right rung A slots 7 (FIG. 4) that form rung containment areas 49 (FIG. 6A) to fit to and rest over the ladder's upper rung B 46 (FIG. 4) when mounting the present invention. The left and right jaw assemblies each include an upper jaw segment 34 and a lower jaw segment 35. Similar to the two base to lower ladder rung traction pads 13 (FIG. 3), the two upper jaw grip pads 36 (FIG. 3), extruded downward from left and right upper jaw segments 34 (FIG. 5), help grip the upper rung B 46 (FIG. 4) when mounted to a ladder. Another extruded detail shared by both left and right upper jaw segments 34 (FIG. 5) are the two hanger arm corrugated step down traction pads 14 (FIG. 5). The function of these pads is to provide traction when a user is stepping onto the upper rung B 46 (FIG. 4) and a misstep falls on the top of an upper rung hanger arm 3/4 (FIG. 5). Without the grip pad surface at that point, traction will be poor and could lead to slipping. The previously mentioned left and right lower jaw segments 35 (FIG. 5) extrude rearward from upper areas of the left and right upper rung hanger arms 3/4 (FIG. 5) leaving a gap between the left and right upper jaw segments 34 and the left and right lower jaw segments 35 to allow the upper rung B 46 (FIG. 4) to fit into the resulting left and right rung B slots 50 (FIG. 6B). The left and right lower jaw segments 35 also serve to prevent the rear area of the base 1 from dangerous lifting and teetering movements while in use.

Figure 9A:
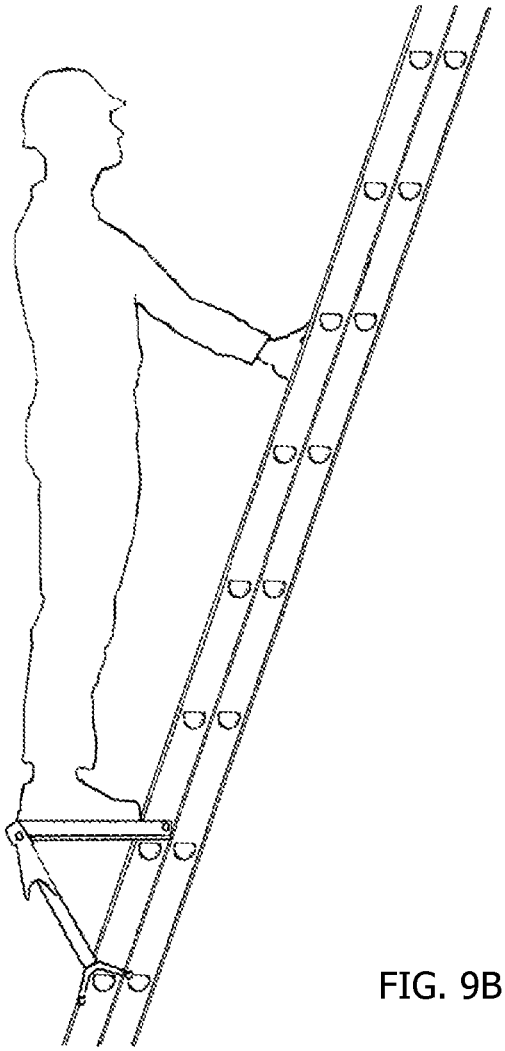
FIG. 9A is the first of two right side views of two comparable ladder platform designs, how they mount on a standard ladder, and how the user's standing position is arranged.
Figure 9B:
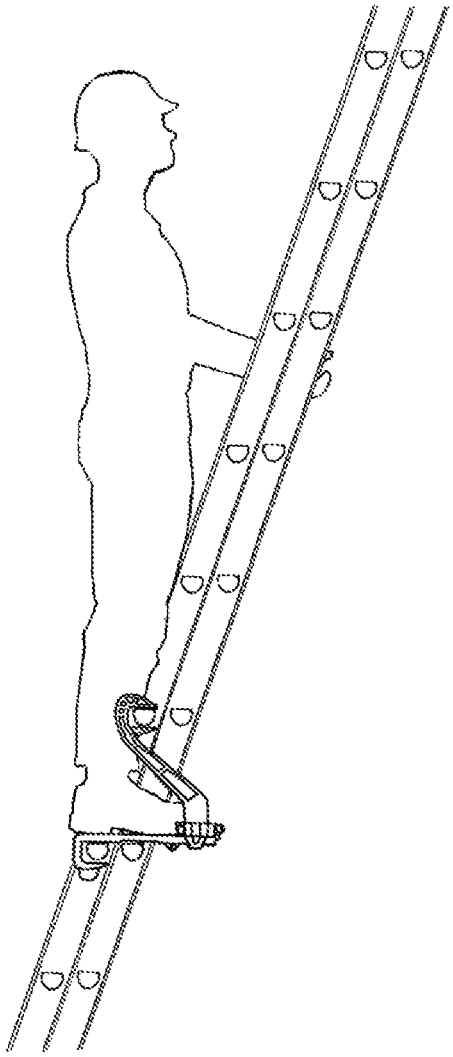
FIG. 9B is the second of two right side views of two comparable ladder platform designs. This drawing depicts the invention (subject of this application) mounted to a cutaway view of a typical ladder. An image of a user standing on the platform illustrates the user's position in relation to the ladder and as compared to the position on the generic ladder platform in FIG. 9A.

As pointed out in Background of the Invention, serious safety problems of one kind or another have been left unaddressed by previous ladder platform designs, potentially placing a user unnecessarily in jeopardy of injury. A currently popular ladder platform design shown in FIG. 9A has several safety issues including an exposed platform away from a ladder's 'safe zone' between the ladder rails and over the supporting rung. User safety is at risk standing on a simple platform base placed outward from a ladder with no edge guard to warn against falling. Stepping up or down the ladder is inhibited by the illustrated device due to the outward reaching platform base that blocks climbing past it. FIG. 9B compares how the Portable Ladder Platform avoids these problems by placing the platform base inward from the supporting rung. The present invention eliminates or reduces several of these and other problems, while also promising to be practical and simple and easy to use.

What is claimed is:

1. A portable ladder platform comprising:

a base, wherein said base is made of plastic and rectangular in shape, designed to sit on a base rung A; said base comprising a top surface, a front, a rear, a left, and a right downward reaching vertical walls, wherein said front, rear, left and right downward reaching vertical walls extend downward from a base perimeter;

a base rib array, wherein said base rib array extends downward from said top surface and extends inward from said front, rear, left, and right downward reaching vertical walls;

a base locking handle cradle, wherein said base locking handle cradle extends downward from a middle area of said top surface of said base;

two base to lower ladder rung traction pads, wherein said two base to lower ladder rung traction pads extend downward from two respective front corner areas of said base rib array to sit on said base rung A;

a base rear edge slip guard, wherein said base rear edge slip guard extends upward from said rear downward reaching vertical wall; and left and right base lower rung hooks, wherein said left base lower rung hook extends vertically downward and horizontally rearward from a left area of said front downward reaching vertical wall and said right base lower rung hook extends vertically downward and then horizontally rearward from a right area of said front downward reaching vertical wall; and left and right upper rung hanger arms; said left and right upper rung hanger arms are made of plastic and are attached to respective left and right rear corners of said base and further extend upward to sit on a second upper rung B above and adjacent to said base rung A; left and right hanger arm hinge knuckles, wherein said left and right hanger arm hinge knuckles extend downward from said left and right upper rung hanger arms.

2. The portable ladder platform of claim 1 further comprising: two upper jaw grip pads, wherein said two upper jaw grip pads extend downward from said left and right upper rung hanger arms to improve grip while said left and right upper rung hanger arms are in contact with said upper rung B.

3. The portable ladder platform of claim 1 further comprising: a base traction grid, wherein said base traction grid is made of plastic and extends upward within the perimeter of said base to provide enhanced traction for a user standing on the portable ladder platform mounted to a straight or extension ladder; and two hanger arm step down traction pads, wherein said two hanger arm step down traction pads extend upward from uppermost areas of said left and right upper rung hanger arms to provide enhanced traction to the user.

4. The portable ladder platform of claim 1 further comprising: left and right rung A slots, wherein said left and right rung A slots are three-sided apertures formed as a product of said left and right base lower rung hooks together with forward segments respectively of said left and right downward reaching vertical walls; and a threaded dowel socket, wherein said threaded dowel socket extends downward from said left base lower rung hook.

5. The portable ladder platform of claim 1 further comprising: left and right hanger arm-to-base hinge assemblies, wherein said left and right hanger arm-to-base hinge assemblies connect said base to said left and right upper rung hanger arms; left and right base hinge knuckles, wherein said left and right base hinge knuckles are part of said left and right hanger arm-to-base hinge assemblies extending upward from said respective left and right rear corners of said base; said left and right hanger arm hinge knuckles are part of said left and right hanger arm-to-base hinge assemblies extending downward from lower ends of said left and right upper rung hanger arms; two hanger arm hinge bolts and two hanger arm hinge locknuts, wherein said two hanger arm hinge bolts and two hanger arm hinge locknuts serve as hinge pins for said left and right hanger arm-to-base hinge assemblies.

6. The portable ladder platform of claim 1 further comprising: a locking handle, wherein said locking handle is fitted to said base locking handle cradle; two locking handle side rails, wherein said two locking handle side rails are parts of said locking handle positioned left and right extending rear to front to seat said locking handle into said base locking handle cradle no higher than top surface of said base; two locking handle hinge assemblies; wherein said two locking handle hinge assemblies connect said locking handle to said base locking handle cradle; four locking handle cradle hinge knuckles, wherein said four locking handle cradle hinge knuckles form part of said two locking handle hinge assemblies extending downward from rear corners of said base locking handle cradle; two locking handle hinge knuckles, wherein said two locking handle hinge knuckles are part of said two locking handle hinge assemblies extending approximately 45 degrees downward and rearward from rear ends of said two locking handle side rails; two locking handle hinge knuckle passages, wherein said two locking handle hinge knuckle passages are two top to bottom through openings positioned at the rear end of said base locking handle cradle to permit alignment of said left and right locking handle hinge knuckles with said locking handle cradle hinge knuckles for assembly; two locking handle limitation pads, wherein said two locking handle limitation pads are angled surfaces at the rearmost sides of said two locking handle hinge knuckle passages restricting pivot range of said locking handle; and two locking handle bolts and two locking handle locknuts, wherein said two locking handle bolts and two locking handle locknuts serve as hinge pins for said two locking handle hinge assemblies.

7. The portable ladder platform of claim 1 further comprising: a locking handle grip rod, wherein said locking handle grip rod is an oval rod that extends perpendicular between the front ends of said two locking handle side rails to join and thus serve as a grip for pivoting said locking handle in an up or down motion; two locking handle gate prongs, wherein said two locking handle gate prongs extend downward from the front ends of said two locking handle side rails; two cradle gate prong passages, wherein said two cradle gate prong passages are top-to-bottom through openings at the front end of said base locking handle cradle directly below said two locking handle gate prongs; rung containment areas, wherein two of said rung containment areas exist as the spaces formed within said left and right rung A slots into which a ladder's base rung A is inserted during mounting and two of said rung containment areas exist as the spaces formed within said left and right rung B slots into which a ladder's upper rung Bis inserted during mounting.

8. The portable ladder platform of claim 1 further comprising: left and right hanger arm jaw assemblies, wherein said left and right hanger arm jaw assemblies extend perpendicular and rearward from an upper area of said left and right upper rung hanger arms; left and right upper jaw segments, wherein said left and right upper jaw segments extend perpendicular and rearward from the topmost area of said left and right upper rung hanger arms as parts of said left and right hanger arm jaw assemblies; and left and right lower jaw segments, wherein said left and right lower jaw segments extend rearward from an upper area of said left and right upper rung hanger arms as parts of said left and right hanger arm jaw assemblies.

9. The portable ladder platform of claim 1 further comprising: left and right hanger arm snap latches, wherein said left and right hanger arm snap latches extend vertically downward from the outward sides of said left and right hanger arm hinge knuckles to latch over said left and right base downward reaching vertical walls when said left and right upper rung hanger arms are pivoted to an upright position.

10. The portable ladder platform of claim 1 further comprising: a horizontal adjustment dowel, wherein said horizontal adjustment dowel is plastic, threaded and enlarged at one end to serve as a hand adjustable knob to enhance stability by screwing said horizontal adjustment dowel through said threaded dowel socket consequently removing variable excess lateral space between the portable ladder platform and the rails of a straight or extension ladder on which said portable ladder platform is mounted.

* * * * *